United States Patent [19]

Truitt et al.

[11] 4,368,914

[45] Jan. 18, 1983

[54] PICKUP UNIT FOR RELEASABLE CONNECTION TO A PARTIALLY EMBEDDED MEMBER

[75] Inventors: Robert E. Truitt, Carson, Calif.; Homer E. Berry, Parsons, Kans.

[73] Assignee: Superior Concrete Accessories, Inc., San Diego, Calif.

[21] Appl. No.: 224,324

[22] Filed: Jan. 12, 1981

[51] Int. Cl.[3] ..... B66C 1/36

[52] U.S. Cl. ..... 294/83 R; 294/89

[58] Field of Search ..... 294/83 R, 84, 89, 90, 294/78 R; 24/230.5 R, 232, 241; 52/125, 698, 699, 700

[56] References Cited

U.S. PATENT DOCUMENTS

| | | | |
|---|---|---|---|
| 3,883,170 | 5/1975 | Fricker . | |
| 4,017,115 | 4/1977 | Holt et al. . | |
| 4,068,879 | 1/1978 | Torbet et al. . | |
| 4,173,367 | 11/1979 | Haeussler | 294/83 R |
| 4,204,711 | 5/1980 | Lancelott et al. . | |

FOREIGN PATENT DOCUMENTS

| | | | |
|---|---|---|---|
| 715432 | 2/1978 | U.S.S.R. | 294/83 R |

OTHER PUBLICATIONS

Publication of the Dayton Sure Grip & Shore Company entitled "The Split Lift System for Tilt-Up Construction by Dayton Sure Grip".

*Primary Examiner*—James B. Marbert

*Attorney, Agent, or Firm*—Gerlach, O'Brien & Kleinke

[57] ABSTRACT

A pickup unit for releasable connection to an anchor insert embedded in a body, such insert having an exposed head portion and a reduced shank portion extending from the head portion and into the body, includes a connecting member rotatable adjacent to the insert head portion, such connecting member having a recess of the bayonet slot type receiving the insert head portion captive within the connecting member while the insert shank portion extends outwardly therefrom upon relative rotation between the connecting member and the insert in one direction, and such connecting member releasing the insert head portion upon such relative rotation in the opposite direction, a latch mounted for in and out movement relative to the recess for respectively preventing and permitting relative movement of the insert head portion out of the recess, a lever movably connected to the connecting member, structure for coupling the lever and the latch, and structure for engaging the lever with such body, whereby a force may be applied to the lever for moving the same relative to the connecting member, thereby to cooperatively move the latch outwardly relative to the recess and rotate the connecting member for releasing the pickup unit from the insert.

9 Claims, 12 Drawing Figures

PICKUP UNIT FOR RELEASABLE CONNECTION TO A PARTIALLY EMBEDDED MEMBER

BACKGROUND OF THE INVENTION

This invention relates to a pickup unit for releasable connection to a partially embedded member, particularly, an anchor insert embedded in a body such as a concrete body.

U.S. Pat. No. 4,173,367 to Haeussler, particularly, FIG. 11 thereof, discloses a pickup unit of the foregoing type, which has been in widespread commercial use for lifting concrete bodies. Nevertheless, there remains room for improvement. In particular, the trip line thereof employed for release purposes in use is passed over a pulley which must be connected to the crane cable or spreader beam, requiring extra parts and operations, and there may be a problem of lines tangling. Remote release of the pickup unit at times requires more than one pull on the trip line, and consumes additional time.

SUMMARY OF THE INVENTION

The present invention constitutes an improvement on the pickup unit disclosed in the aforesaid U.S. Pat. No. 4,173,367, particularly FIG. 11 thereof. The structure of the invention employs lever action for performing the release operations, and the structure utilizes the body to be lifted as a reaction member for firm, reliable disengagement of the pickup unit from the body, while actuating the unit from a remote location by means of a lanyard or the like when necessary or desirable.

More particularly, the invention provides an improvement in a pickup unit for releasable connection to an anchor insert or the like embedded in a body, such insert having an exposed head portion and a reduced shank portion extending from the head portion and into the body, wherein the pickup unit includes a connecting member rotatable adjacent to the insert head portion, the connecting member having a recess of the bayonet slot type receiving the insert head portion captive within the connecting member while the insert shank portion extends outwardly therefrom upon relative rotation between the connecting member and the insert in one direction, and the connecting member releasing the insert head portion upon such relative rotation in the opposite direction, and a latch mounted for in and out movement relative to the recess for respectively preventing and permitting relative movement of the insert head portion out of the recess. In accordance with the invention, lever means are movably connected to the connecting member, means are provided for coupling the lever means and the latch, and means are provided for engaging the lever means with such body, whereby a force may be applied to the lever means for moving the same relative to the connecting member, thereby to cooperatively move the latch outwardly relative to the recess and rotate the connecting member for releasing the pickup unit from the insert. In preferred embodiments, a lanyard or the like is operated from a remote location to apply to the lever means the force which serves to release the pickup unit.

The invention provides for direct attachment of such lanyard or the like to the pickup unit, without need for an intervening pulley or other additional structure. Problems of tangling or fouling trip lines are minimized. Faster, positive release of the pickup unit is achieved with a single good pull on the lanyard. The structure is rugged and reliable, and it functions consistently during repeated uses.

In a further preferred embodiment of the invention, means are provided in association with the aforesaid coupling means for resiliently biasing the latch in the direction of its inward movement relative to the recess in the connecting member. The structure serves to lock the latch in use, thereby preventing any unintended escape of the anchor insert from the connecting member.

The foregoing and other objects, advantages and functions of the invention will be apparent upon consideration of the following description, taken in conjunction with the accompanying drawings.

BRIEF DESCRIPTION OF THE DRAWINGS

The attached drawings illustrate a preferred embodiment of the invention, without limitation thereto. In the drawings, like elements are identified by like reference symbols in each of the views, and.

DESCRIPTION OF THE PREFERRED EMBODIMENT

Figure 1:
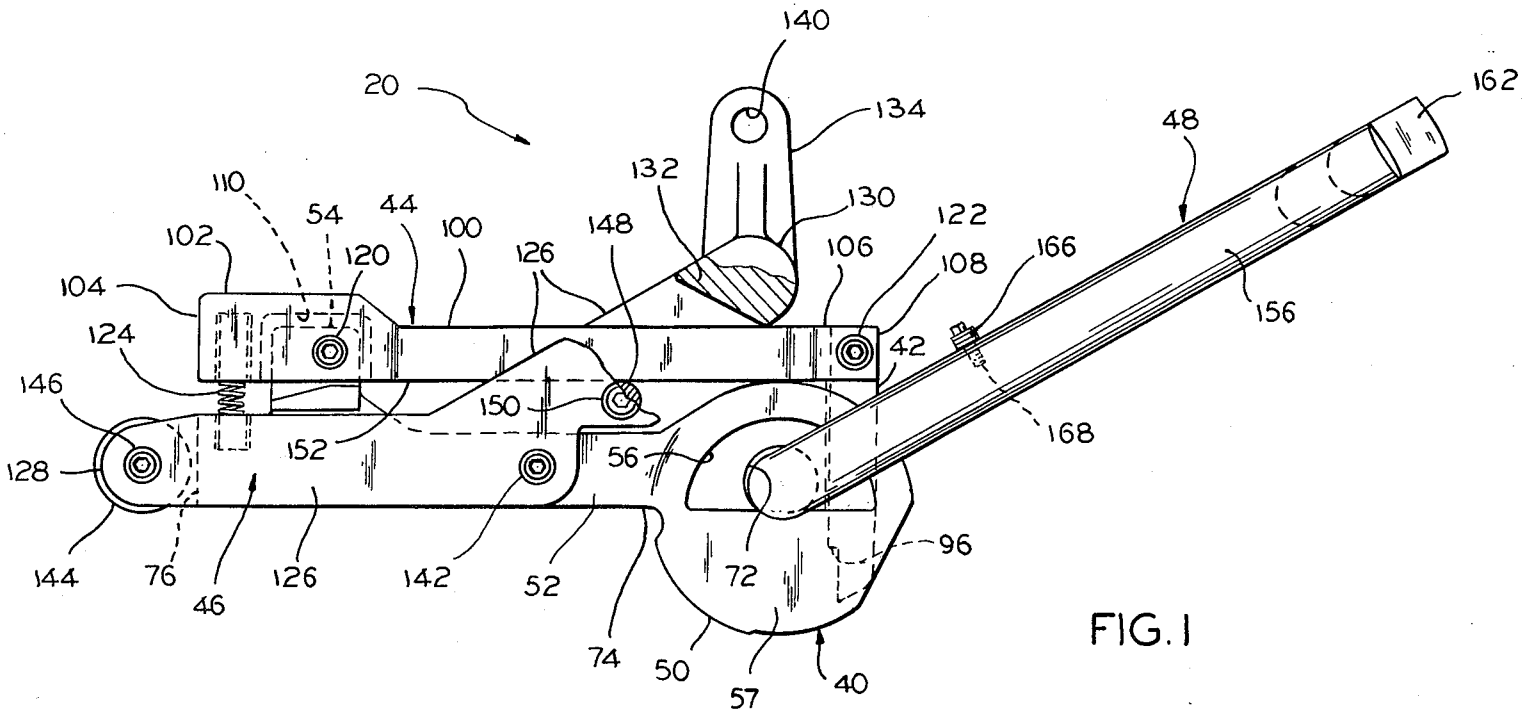
FIG. 1 is a side elevational view, with parts broken away and in section, of a pickup unit constructed in accordance with the invention.
Figure 3:
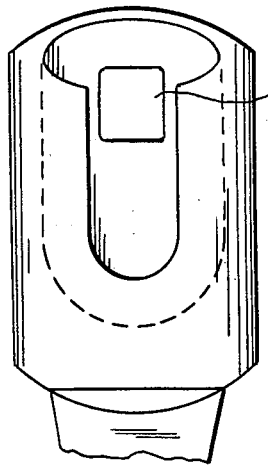
FIG. 3 is a fragmentary bottom plan view of the connecting member, on the same scale.

Referring to FIGS. 1, 4, and 10–12 of the drawings, a pickup unit or assembly 20 constitutes a preferred embodiment of the invention. The pickup unit is constructed for releasable connection to a bolt-type anchor insert 22 embedded in a body 24, which in the preferred embodiments is a concrete body to be lifted by a crane or other suitable lifting or hoisting apparatus. The pickup unit cooperates with the embedded insert 22 generally in the same manner as disclosed in the aforesaid U.S. Pat. No. 4,173,367, particularly in connection with FIG. 11 thereof. The pickup unit is especially advantageous in the "tilt-up" erection of large and heavy concrete slabs which are incorporated in building structures as wall panels.

The insert 22 preferably is constructed integrally in one piece of a generally frusto-conical base or foot portion 26 (see FIG. 10), a centrally disposed upstanding cylindrical shank portion 28 having one end integral with the base portion, a generally frusto-conical neck portion 30 integral with the opposite end of the shank portion and diverging therefrom, and a relatively shallow generally cylindrical head portion 32 integral with the outer end of the neck portion and having a diameter which is greater than the diameter of the shank portion 28. The shank portion 28 is reduced with respect to the head portion 32, for a purpose which will become apparent.

Figure 10:
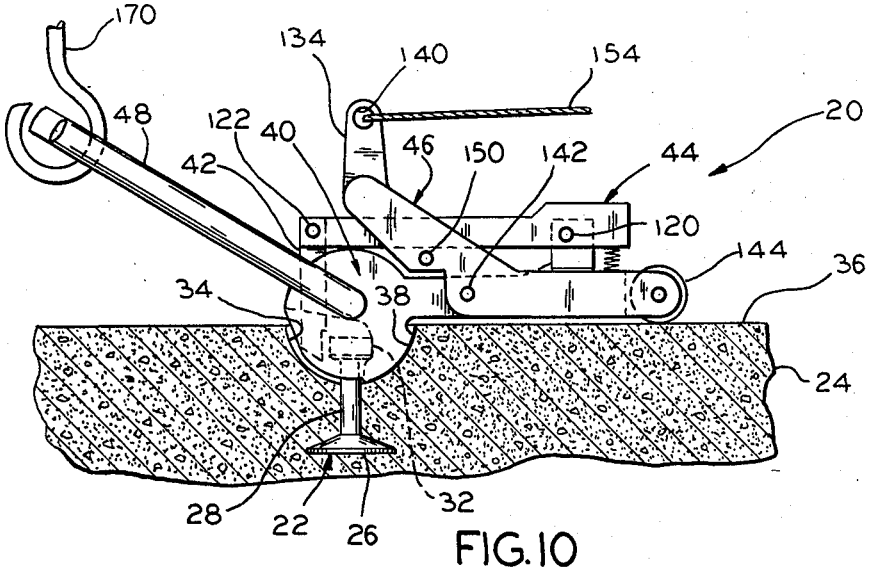
FIGS. 10–12 are sequential schematic views showing the pickup unit in use for lifting a concrete body such as a slab or panel, FIGS. 10 and 11 showing the unit as it appears when securely connected to an anchor insert, and FIG. 12 showing the unit as it appears in the course of releasing it from the insert.
Figure 11:
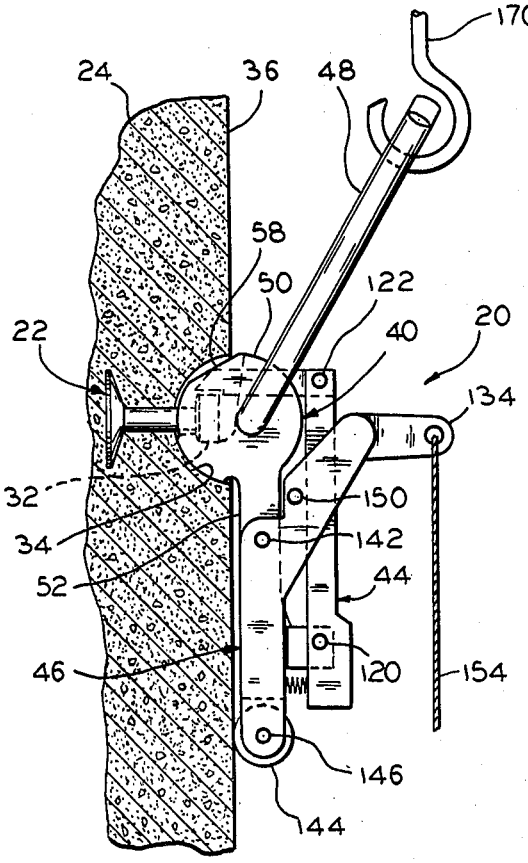
Figure 12:
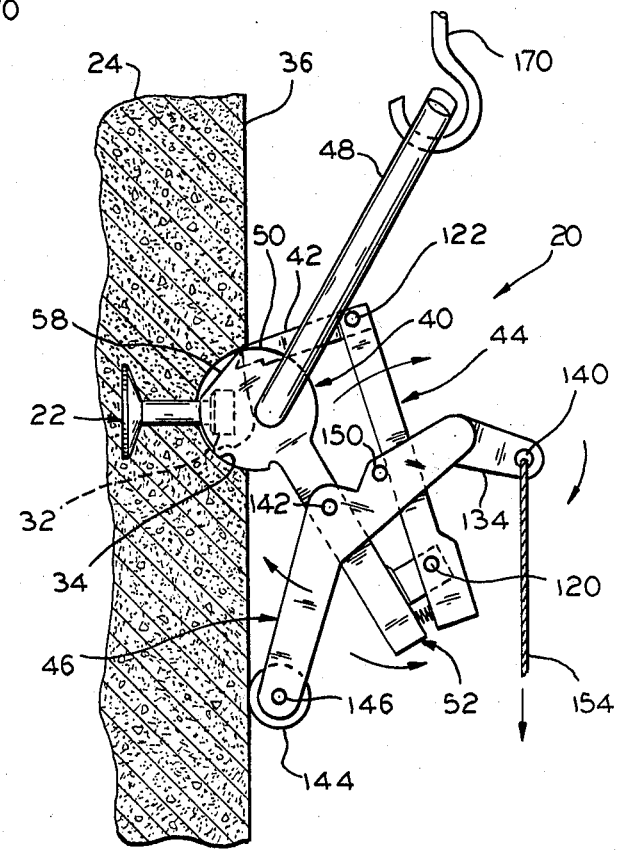

As seen in FIGS. 10–12, the insert 22 is partially embedded in the concrete body 24, so that the head portion 32 is exposed for connection to the pickup unit 20, and the shank portion 28 extends from the head portion and into the body 22, where the base portion 26 and a major proportion of the shank portion 28 are firmly embedded. The head portion 32 is encompassed within an arcuate recess 34, which is formed in the upper (as cast) or outer face surface 36 of the body 24 in known manner, in the process of casting the body with a plurality of inserts 22 disposed at appropriate locations therein.

In the illustrative structure, the recess 34, in general, is in the shape of a partial section of a sphere, and is bounded by an approximately semi-circular and transversely arcuate bottom wall surface 38 and two generally flat parallel side wall surfaces, which are not visible in the illustrations. The head portion 32 and the neck portion 30 of the insert are spaced from the bottom wall surface 38 of the recess 34, and the free upper or outer surface of the head portion 32 preferably is spaced below the face surface 36 of the body 24, for purposes which will appear.

The pickup unit 20 includes a so-called spoon-type connecting member 40, a safety latch 42 movably mounted on the connecting member, a latch actuator or lever 44 movably connected to the connecting member and coupled with the latch, a release lever 46 movably connected to the connecting member, and a lifting bail or shackle 48 movably connected to the connecting member. Each of the foregoing parts or elements of the pickup unit 20 preferably is integrally constructed in one piece of high strength steel.

Referring to FIGS. 1–5, the connecting member 40 is constructed integrally of a rounded engagement portion 50, an elongated actuating portion 52, and a block-like supporting portion 54. The engagement portion 50, in general, resembles a section of a sphere having a transverse axis 55, with portions cut away. Thus, arcuate recesses 56 (FIG. 1) are formed in opposite side surfaces 57, to provide clearance for the bail 48. A mouth 58 of an engagement recess 60 is formed as the intersection of a plane and a section of a sphere. A peripheral surface 62 of the engagement portion 50, in general, is peripherally and transversely arcuate, corresponding in this respect to the bottom wall surface 38 bounding the recess 34 in the body 24.

Figure 5:
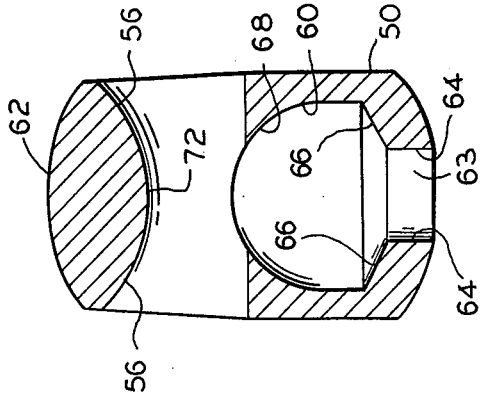
FIG. 5 is a cross-sectional view of an engagement portion of the connecting member, on the same scale, taken substantially on line 5—5 of FIG. 4.
Figure 2:
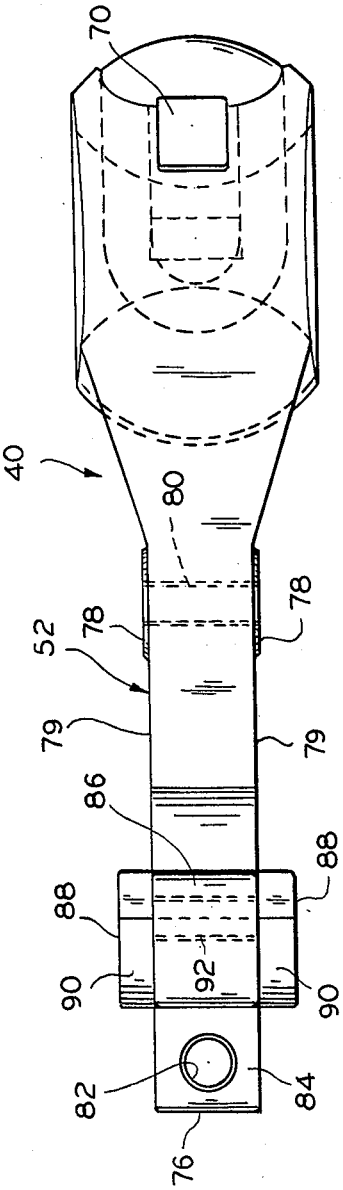
FIG. 2 is an enlarged top plan view of a connecting member thereof.
Figure 4:
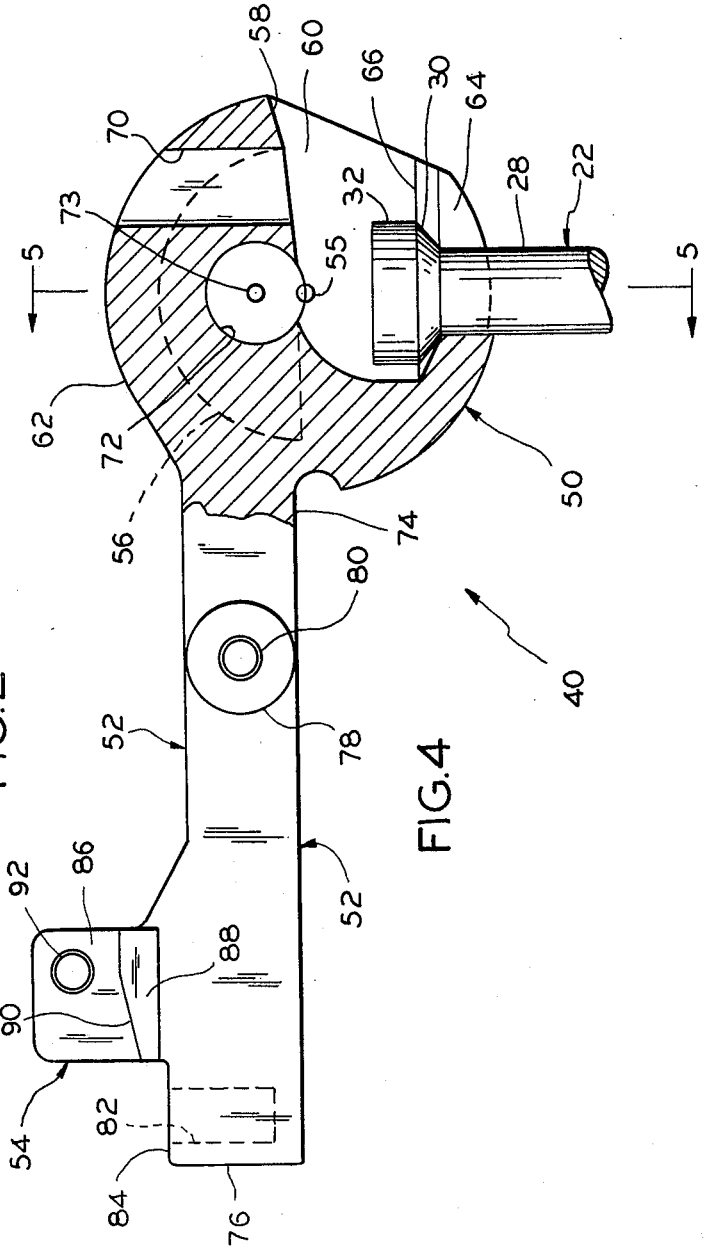
FIG. 4 is a side elevational view of the connecting member, with a portion broken away and in section, on the same scale, which also illustrates a portion of an anchor insert in engagement therewith.

The engagement recess 60 is of the bayonet slot type, as seen most clearly in FIGS. 4 and 5. The recess 60 includes a relatively narrow elongate portion 63 extending inwardly from the peripheral surface 62 and bounded by parallel insert-guiding side wall surfaces 64, an inwardly divergent portion bounded by a U-shaped inclined shoulder 66, and a relatively wide and deep elongate portion 68 extending radially inwardly to slightly past the transverse axis 55. The recess 60 extends around the outer surface of the engagement portion 50 for an angular distance of approximately 110° in the illustrative embodiment. While the neck portion 30 of the insert 22 and the shoulder 66 in the engagement portion 50 are illustrated in straight lines, the surfaces thereof may be slightly curved in actual practice.

A latch-receiving opening 70 of rectangular cross-section extends secantally in the engagement portion 50 from the peripheral surface 62 to the wide portion 68 of the recess 60. The opening 70 diverges slightly in the direction of the surface 62. A bail-receiving opening 72 of circular configuration and having a transverse axis 73 extends between the bail-receiving recesses 56. The axis 73 of the bail-receiving opening 72 is radially spaced from or eccentric with respect to the axis 55 of the engagement portion 50, so that the bail-receiving opening 72 is disposed to one side of the engagement recess 60, only slighly overlapping the wide portion 68 thereof.

The engagement portion 50 is connected to the insert 22 and released therefrom by relative rotational movement between them. FIGS. 11 and 12 illustrate the manner in which the engagement portion 50 is rotatable on the body 24 in the recess 34 therein, adjacent to the insert head portion 32, for such purposes. Referring to FIG. 4, the engagement portion 50 rotates substantially about the transverse axis 73 of the bail-receiving opening 72. The insert-guiding side wall surfaces 64 of the engagement recess 60 extend in planes substantially perpendicular to such axis of rotation.

The engagement recess 60 receives the head portion 32 of the insert 22 captive within the engagement portion 50 while the insert shank portion 28 extends outwardly therefrom upon relative rotation between the engagement portion and the insert in one direction, and the engagement portion releases the insert head portion upon such relative rotation in the opposite direction, as most clearly appears from FIGS. 4 and 5. The head portion 32 enters the wide portion 68 of the engagement recess 60 through the mouth 58, and the wide portion provides room for variations in the distance for which the insert 22 extends out of the body 24 and into the body recess 34. The insert neck portion 30 is disposed adjacent to the shoulder 66 in the engagement portion 50, for engagement therewith during a lifting operation. The insert shank portion 28 extends outwardly through the narrow recess portion 63, with sufficient clearance to enable the engagement portion 50 to be connected to the insert 22 and released therefrom readily.

The actuating portion 52 of the connecting member 40 extends outwardly from the engagement portion 50, and from a proximal end 74 of the actuating portion, which is integral with the engagement portion, to a distal end 76 thereof. The actuating portion 52 extends from that part of the engagement portion 50 which contains the bail-receiving opening 72, approximately radially from the axis 73 of such opening. The actuating portion 52 extends in substantially the same direction as the direction in which the engagement recess 60 extends into the engagement portion. The mouth 58 is on the opposite side of the engagement portion to the actuating portion 52.

Two circular bosses 78 are formed on opposite sides 79 of the actuating portion 52, and a cylindrically-tubular bushing 80 extends between the bosses in a corresponding opening provided in the actuating portion. The bushing 80 is disposed intermediate the aforesaid proximal and distal ends 74 and 76. A circular spring-receiving recess or blind bore 82 extends inwardly from the top surface 84 of the actuating portion 52, adjacent to the distal end 76. The supporting portion 54 is disposed adjacent to the distal end 76 and between the spring-receiving recess 82 and the bushing 80. The supporting portion 54 includes a central rectangular actuator fulcrum portion 86 and laterally extending integral wings 88 on opposite sides thereof. A cylindrically-tubular bushing 92 extends between opposite sides of the fulcrum portion 86 in a corresponding opening in such portion. The wings have surfaces 90 sloping towards the distal end 76, to provide clearance for pivotal movement of the latch actuator 44.

Figure 7:
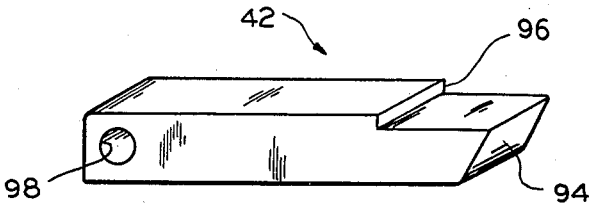
FIG. 7 is a perspective view of a safety latch in the pickup unit.

Referring to FIG. 7, the safety latch 42 has a substantially rectangular cross-section, and it is provided with a rectangularly-shaped clearance recess 96 on one side and at one end of the latch, which recess extends for the full width of the side. The latch terminates at such end in a surface 94, which is inclined rearwardly from the recess 96. A cylindrical opening 98 is provided in the latch adjacent to its opposite end, and the opening extends between opposite sides of the latch. The latch 42 is received in the latch-receiving opening 70 in the engagement portion 50, as illustrated in FIG. 1, with sufficient play to enable the latch to move freely in and out relative to the engagement recess 60. When inserted to its maximum extent, the latch is disposed between the insert head portion 32 and the mouth 58 of the engagement recess, while being contained within the recess, thereby to prevent relative movement of the head portion 32 out of the recess. The latch recess 96 faces the head portion 32, thereby to space the latch from the head portion and provide freedom of relative movement therebetween. The latch 42 is moved outwardly with respect to the engagement recess 60 when it is desired to permit movement of the head portion 32 out of the recess. The respective positions of the latch are illustrated in FIGS. 11 and 12.

Figure 6:
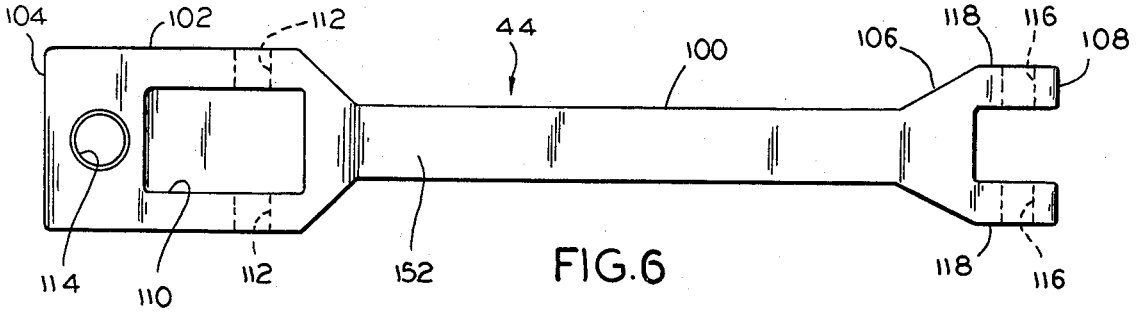
FIG. 6 is a bottom plan view of a latch actuator in the pickup unit, on the same scale.

Referring to FIGS. 1 and 6, the latch actuator 44 is an elongated member which includes a relatively long arm portion 100 extending between an enlarged mounting portion 102 at a distal end 104 of the actuator, and an enlarged bifurcated portion 106 at a proximal end 108 of the actuator. The mounting portion 102 includes a substantially rectangular mounting recess 110 adapted for receiving the fulcrum portion 86 of the connecting member 40 therein and spaced apart, as seen in FIG. 1. Coaxial transverse cylindrical openings 112 are provided in the sides of the mounting portion 102, in communication with the mounting recess 110. A circular spring-receiving recess or blind bore 114 is provided in the mounting portion 102, between the mounting recess 110 and the distal end 104. Coaxial transverse cylindrical openings 116 are provided in the bifurcations 118.

Referring to FIG. 1, the mounting portion 102 of the actuator 44 is mounted on the supporting portion 54 on the actuating portion 52 for relative movement of the actuator about a pivotal axis, by means of a bolt and nut combination 120, the bolt of which extends through the openings 112 in the mounting portion 102 of the actuator 44 and the registering bushing 92 in the supporting portion 54 of the connecting member 40. The bifurcated portion 106 of the actuator 44 is connected to the latch 42 for relative pivotal movement of the latch, by means of a bolt and nut combination 122, the bolt of which is inserted through the openings 116 in the bifurcations 118 and through the registering opening 98 in the latch. A coil compression spring 124 is mounted with its opposite ends held captive in the spring-receiving recesses 82 and 114 of the connecting member 40 and the actuator 44, respectively, whereby means are provided for resiliently biasing the latch 42 in the direction of its inward movement relative to the engagement recess 60.

Figure 8:
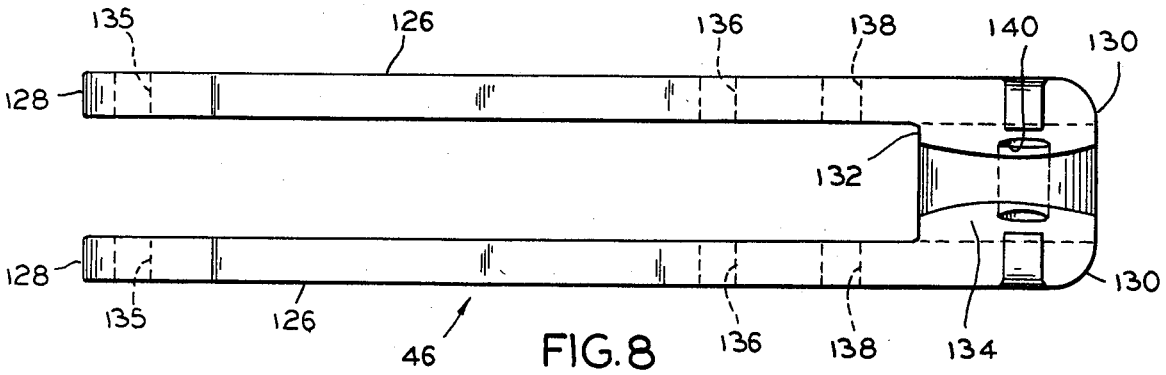
FIG. 8 is a top plan view of a release lever in the pickup unit, on the same scale as FIGS. 2–6.

Referring to FIGS. 1 and 8, the release lever 46 is a yoke-like member which includes a pair of spaced apart angular arms 126 having adjacent free ends 128 and opposite ends 130 integrally joined together by a solid connecting portion 132 from which extends an integral attachment lug 134. Pairs of coaxial transverse cylindrical openings 135, 136, and 138 extend through the arms 126, such openings being spaced apart along the arms. One pair of openings 135 is adjacent to the free ends 128. A second or intermediate pair of openings 136 is disposed intermediate the ends 128 and 130. The remaining pair of openings 138 is disposed between the second pair of openings 136 and the connecting portion 132. A cylindrical transverse attachment opening 140 extends through the attachment lug 134.

The release lever 46 is mounted on the actuating portion 52 of the connecting member 40 for movement about a pivotal axis, with the lever arms 126 straddling the actuating portion, by means of a bolt and nut combination 142, the bolt of which extends through the second pair of openings 136 in the arms 126 and the registering bushing 80 (FIG. 4) in the actuating portion 52. A skid roller 144 is rollably mounted between the free ends 128 of the release lever 46, outwardly of the distal end 76 of the actuating portion 52, by means of a bolt and nut combination 146 inserted through the pair of openings 135 at the free ends and a registering axial tubular bushing (not visible) in the roller. The roller 144 provides low friction means for engaging the concrete body 24.

A cam roller 148 (FIG. 1) is mounted to extend between the lever arms 126, by means of a bolt and nut combination 150 inserted through the remaining pair of openings 138 in the arms and through a registering opening in the roller. The roller 148 is disposed adjacent to the inner surface 152 of the actuator arm portion 100, for low friction rolling engagement therewith. The attachment opening 140 is provided in the attachment lug 134 for connection of a force-transmitting member to the lug, whereby a force may be applied to the release lever 46 for moving the lever relative to the actuating portion 52 of the connecting member 40. In the preferred illustrative embodiment, as illustrated in FIGS. 10–12, a lanyard 154 is inserted through the opening 140 for attachment to the lug 134.

Figure 9:
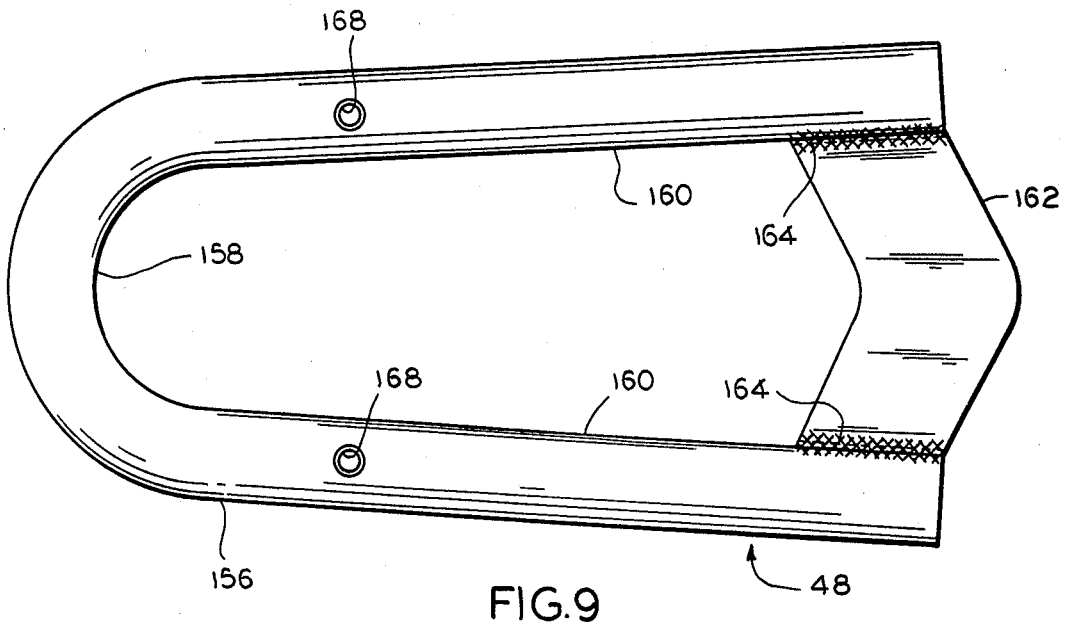
FIG. 9 is a top plan view of a lifting bail in the pickup unit.

Referring to FIGS. 1 and 9, the lifting bail 48 in the illustrative embodiment is constructed of a cylindrical rod 156 reversely bent on itself to form a bight portion 158 and a pair of slightly divergent leg portions 160, and a V-shaped bar 162 secured at its opposite ends to the opposite ends of the rod therebetween by welds 164. In assembling the pickup unit 20, the rod 156 is inserted through the bail-receiving opening 72 in the engagement portion 50 of the connecting member 40, and the bar 162 is welded to the rod 156 thereafter. The rod 156 is provided with screw and washer combinations 166 received in corresponding openings 168 in the respective leg portions 160 of the rod. The screw and washer combinations serve as stops, to limit the movement of the rod 156 in either direction through the bail-receiving opening 72 once the bail is assembled in the pickup unit 20.

In general, the pickup unit 20 is connected to an anchor insert 22 in the conventional manner for a spoon-type unit. Thus, referring to FIGS. 1 and 4, the latch 42 may be removed from the recess 60 in the engagement portion 50 of the connecting member 40 by grasping the actuating portion 52 of the connecting member and the latch actuator 44 at their adjacent distal ends 76 and 104, respectively, and squeezing. The engagement portion 50 is inserted into the recess 34 in the concrete body 24, and rotated so that it engages the insert 22, with the head portion 32 passing through the mouth 58 and entering the recess 60, until it reaches the position illustrated in FIG. 4. The unit is released as it reaches the position of the connecting member 40 illustrated in FIG. 10, thereby releasing the latch 42 to move into the engagement recess 60 under the bias of the compression spring 124. The application of a generally downward hand pressure to the attachment lug 134 will insure that the latch 42 is fully inserted, by the resulting force transmitted to the actuator arm portion 100 from the connecting portion 132 of the release lever. At that time, the parts are disposed in their positions illustrated in FIGS. 1 and 10, wherein the free ends 128 of the lever arms 126 are disposed adjacent to the distal end 76 of the actuating portion 52. The skid roller 144 engages the face surface 36 of the body 24, and the actuating portion 52 and the lever arm portions adjacent to the free ends 128 are adjacent to and approximately parallel to the face surface 36. A hook 170 suspended by a crane cable or the like is attached to the bail 48, for engagement with the bar 162 of the bail. The hook may be attached to the bail 48 before or after the pickup unit 22 is connected to the insert 22.

A number of spaced apart pickup unit and insert combinations are distributed across the surface 36 of the concrete body 24, in accordance with the load requirements and in known manner. Crane cables and hooks 170 are attached to the bails 48 of the several pickup units, and a normal or conventional tilt-up operation is conducted. In such operation, the concrete body 24 is lifted from its initial horizontal position as cast to a vertical position, with one end of the body, to become the upper end, being raised relative to the opposite end. The body 24 moves through a series of inclined positions until, ultimately, it is erected in a vertically extending position and braced, as illustrated in FIG. 11. At such time, the lifting cables are relaxed and the pickup units 20 may be disconnected from the inserts 22 and removed from the body 24.

In order to disconnect a pickup unit 20 from an insert 22, a procedure is followed which is substantially the reverse of the procedure for connecting the pickup unit to the insert. Employing the new pickup unit 20, the pickup unit may be removed simply by a good pull on the lanyard 154. Referring to FIGS. 11 and 12, a downward pull on the lanyard 154 causes the lever 46 to rotate in a clockwise direction about a pivotal axis provided by the bolt and nut combination 142 mounting the lever on the connecting member 40. The skid roller 144 on the lever reacts against the face surface 36 of the body 24, thereby causing the axis of lever rotation provided by the nut and bolt combination 142 to move outwardly from the face surface. Inasmuch as the engagement portion 50 of the connecting member 40 is constrained by the head portion 32 of the insert 22 to remain in the body recess 34, the entire connecting member 40 moves rotationally, in a counterclockwise direction in the illustrative application.

At the commencement of the rotational movement of the lever 46, the camming roller 148 (FIG. 1) on the lever 46 engages the inner surface 152 of the actuator arm portion 100, and cams the arm portion as the lever 46 is rotated by applied force, to rotate the actuator 44 about the pivotal axis provided by the bolt and nut combination 120 which mounts the actuator on the connecting member 40. The actuator 44 rotates about such axis in the counterclockwise direction as illustrated in FIG. 1, and in the clockwise direction as illustrated in FIG. 12. The actuator 44 is rotated to move the latch 42 outwardly relative to the engagement recess 60 (FIG. 4), cooperatively with the above-described rotation of the engagement portion 50 of the connecting member 40, for releasing the pickup unit 20 from the insert 22.

The illustration of FIG. 12 shows the pickup unit 20 in an intermediate condition between its fully connected condition and its release condition. Further movement of the lanyard 154 by the downward pull thereon causes the lever 46 to rotate further in the clockwise direction, whereby the engagement portion 50 is rotated further in the counter-clockwise direction. When the engagement portion 50 is rotated to an extent sufficient to enable the head portion 32 of the insert 22 to exit from the engagement portion through the mouth 58 of its engagement recess 60, the force applied to the lanyard will cause the connecting member 40 to be separated from the insert 22, and it then will dangle from the cable hook 170. The crane then may be employed to transfer the several pickup units 20 to another concrete body, for attachment of the pickup units to inserts embedded therein. Alternatively, the crane cables may be lowered to the ground, where the pickup units may be removed from the cable hooks. The entire release operation may be performed easily, safely, and rapidly, with no need for the use of ladders and tools to remove the pickup units at elevated locations on the erected concrete bodies. The recesses 34 in the body 40 may be filled with grout in finishing the face surfaces 36, to cover and conceal the insert 22 and provide an even surface on the body.

While a preferred embodiment of the invention has been described and illustrated, it will be apparent to those skilled in the art that various changes and modifications may be made therein within the spirit and scope of the invention. It is intended that all such changes and modifications be included within the scope of the appended claims.

We claim:

1. In a pickup unit for releasable connection to an anchor insert embedded in a body, such insert having an exposed head portion and a reduced shank portion extending from the head portion and into the body, wherein the pickup unit includes a connecting member rotatable adjacent to such insert head portion, said connecting member having a recess of the bayonet slot type receiving the insert head portion captive within the connecting member while the insert shank portion extends outwardly therefrom upon relative rotation between the connecting member and the insert in one direction, and said connecting member releasing the insert head portion upon such relative rotation in the opposite direction, and a latch mounted for in and out movement relative to the recess for respectively preventing and permitting relative movement of the insert head portion out of the recess, the improvement which comprises:

lever means movably connected to said connecting member, means for coupling said lever means and said latch, and means for engaging said lever means with such body, whereby a force may be applied to said lever means for moving the same relative to said connecting member, thereby to cooperatively move said latch outwardly relative to said recess and rotate said connecting member for releasing the pickup unit from the insert.

2. A pickup unit as defined in claim 1 and including means associated with said coupling means for resiliently biasing said latch in the direction of its inward movement relative to said recess.

3. A pickup unit as defined in claim 1 or 2 and including means mounting said lever on said connecting member for movement about a pivotal axis disposed intermediate opposite ends of the lever, said coupling means and said engaging means acting on said lever means respectively on opposite sides of said axis, and means on said lever means adapted for application of said force to the lever means on the same side of said axis as the side on which said coupling means acts.

4. In a pickup unit for releasable connection to an anchor insert embedded in a body, such insert having an exposed head portion and a reduced shank portion extending from the head portion and into the body, wherein the pickup unit includes a connecting member comprising an engagement portion rotatable adjacent to such insert head portion and an actuating portion extending outwardly from the engagement portion for rotation of the latter thereby, said engagement portion having a recess of the bayonet slot type receiving the insert head portion captive within the engagement portion while the insert shank portion extends outwardly therefrom upon relative rotation between the engagement portion and the insert in one direction, and said engagement portion releasing the insert head portion upon such relative rotation in the opposite direction, and a latch mounted for in and out movement relative to the recess for respectively preventing and permitting relative movement of the insert head portion out of the recess, the improvement which comprises:

a latch actuator movably connected to said actuating portion of the connecting member, means for coupling said latch actuator and said latch, lever means movably connected to said actuating portion of the connecting member, and means for engaging said lever means respectively with such body and with said latch actuator, whereby a force may be applied to said lever means for moving the same relative to said actuating portion, thereby to cooperatively move said latch outwardly relative to said recess and rotate said engagement portion of the connecting member for releasing the pickup unit from the insert.

5. A pickup unit as defined in claim 4 and including means associated with said latch actuator for resiliently biasing said latch in the direction of its inward movement relative to said recess.

6. A pickup unit as defined in claim 4 or 5 and including means mounting said lever on said actuating portion for movement about a pivotal axis disposed intermediate opposite ends of the lever, said lever means engaging such body and said latch actuator respectively on opposite sides of said axis, and means on said lever means adapted for application of said force to the lever means on the same side of said axis as the side on which the lever means engages said latch actuator.

7. In a pickup unit for releasable connection to an anchor insert embedded in a body, such insert having an exposed head portion and a reduced shank portion extending from the head portion and into the body, wherein the pickup unit includes a connecting member comprising an engagement portion rotatable adjacent to such insert head portion and an elongated actuating portion extending outwardly from the engagement portion for rotation of the latter thereby, said engagement portion rotating about a transverse axis and having a recess of the bayonet slot type receiving the insert head portion captive within the engagement portion while the insert shank portion extends outwardly therefrom upon relative rotation between the engagement portion and the insert in one direction, and said engagement portion releasing the insert head portion upon such relative rotation in the opposite direction, a latch mounted for in and out movement relative to the recess for respectively preventing and permitting relative movement of the insert head portion out of the recess, and a lifting bail connected to said engagement portion for relative rotation between the two substantially about said transverse axis, the improvement which comprises:

an elongated latch actuator connected to said actuating portion for movement about a pivotal axis disposed adjacent to a distal end of the latch actuator and disposed adjacent to a distal end of the actuating portion, means coupling said latch actuator and said latch adjacent to a proximal end of the latch actuator, a lever connected to said actuating portion for movement about a pivotal axis disposed intermediate said distal end of the actuating portion and a proximal end thereof, and disposed intermediate opposite ends of the lever, means on said lever for engaging such body adjacent to one end of the lever, the latter lever end being disposed adjacent to the distal end of said actuating portion when the pickup unit is connected to such insert, means on said lever for engaging said latch actuator on the opposite side of said axis of lever movement from said one end of the lever, and means on said lever adapted for attachment of a force-transmitting member to the lever for moving the same relative to said actuating portion, the latter means being disposed on the same side of said axis of lever movement as said means for engaging said latch actuator, thereby to cooperatively move said latch outwardly relative to said recess and rotate said engagement portion of the connecting member for releasing the pickup unit from the insert.

8. A pickup unit as defined in claim 7 and including means associated with said latch actuator for resiliently biasing said latch in the direction of its inward movement relative to said recess.

9. A pickup unit as defined in claim 7 or 8 and including a lanyard attached to said lever for transmitting a force to the lever.

* * * * *